US005359929A

United States Patent [19]

Hansen

[11] Patent Number: 5,359,929

[45] Date of Patent: Nov. 1, 1994

[54] DEVICE FOR DELIVERING SIGNATURES IN A PRINTING PRESS

[75] Inventor: Robert E. Hansen, Clarendon Hills, Ill.

[73] Assignee: Rockwell International Corporation, El Segundo, Calif.

[21] Appl. No.: 111,743

[22] Filed: Aug. 25, 1993

[51] Int. Cl.[5] ..... B41F 13/24; B65H 29/20

[52] U.S. Cl. ..... 101/232; 271/83; 271/315

[58] Field of Search ..... 101/232; 271/83, 315, 271/DIG. 900

[56] References Cited

U.S. PATENT DOCUMENTS

| | | | |
|---|---|---|---|
| 4,205,837 | 6/1980 | Hein et al. | 271/315 |
| 4,228,997 | 10/1980 | Schoonmaker et al. | 271/315 |
| 4,618,302 | 10/1986 | Kokubo et al. | 271/315 |
| 4,865,307 | 9/1989 | Crofutt et al. | 271/315 |
| 4,915,371 | 4/1990 | Quinton | 271/315 |
| 4,968,015 | 11/1990 | Calverley et al. | 271/315 |
| 5,040,783 | 8/1991 | Ruehl | 271/315 |
| 5,083,768 | 1/1992 | Ertavi et al. | 271/315 |
| 5,083,998 | 1/1992 | Carter | 271/315 |
| 5,249,791 | 10/1993 | Belanger et al. | 271/315 |
| 5,261,655 | 11/1993 | Keller et al. | 271/315 |

FOREIGN PATENT DOCUMENTS

| | | | |
|---|---|---|---|
| 0344716 | 12/1989 | European Pat. Off. | 271/315 |

*Primary Examiner*—Eugene H. Eickholt
*Attorney, Agent, or Firm*—C. B. Patti; H. F. Hamann

[57] ABSTRACT

A device (14) for delivering signatures (S) in a printing press (10) having a fly (18) having a plurality of open pockets (26) to receive the signatures (S), a device (20) for rotating the fly (18), a device (36) for stripping the signatures (S) from the fly (18) in an exit portion (34) of the fly (18), and a device (32 and 30) for driving the stripping device (36) at a speed relative to the speed of the fly (18) in a manner reducing their relative velocity less than the relative velocity between the fly (18) and a stationary condition of the stripping device (36).

13 Claims, 3 Drawing Sheets

DEVICE FOR DELIVERING SIGNATURES IN A PRINTING PRESS

BACKGROUND OF THE INVENTION

The present invention relates to devices for delivering signatures in a printing press.

In the past, rotary flies having open pockets disposed around the flies have been utilized in printing presses to deliver signatures from a folder in a shingled configuration onto a conveyor belt. During this time, a leading edge of the signatures must be stripped from the pockets of the fly onto the conveyor belt, such as by fixed stripping devices. If the leading edge of the signatures is other than a folded edge, marking of the leading signature edge may take place due to the stripping action at higher speeds of the press, e.g., 2,000–3,000 ft./min. If the marks on the leading edge of the signatures is large enough such that a mark remains after the signature is trimmed, then the signatures are unsalable, and must be discarded, thus resulting in substantial waste of the product.

SUMMARY OF THE INVENTION

A principal feature of the present invention is the provision of an improved device for delivering signatures in a printing press.

The device of the present invention comprises, a fly having a plurality of open pockets to receive signatures, means for rotating the fly, and means for stripping signatures from the fly in an exit portion of the fly.

A feature of the present invention is the provision of means for driving the stripping means.

Another feature of the invention is that the stripping means is driven at a speed relative to the speed of the fly in a manner reducing their relative velocity less that the relative velocity between the fly and a stationary condition of the stripping means.

A feature of the invention is that the movable stripping means prevents marking on the leading edge of signatures even if the edge is not a folded edge.

Thus, a feature of the invention is that the stripping means prevents damage to the signatures, and minimizes waste of the signatures, thus reducing inconvenience and cost associated with operation of the printing press.

Another feature of the invention is that a portion of the stripping means is located in an exit portion of the fly.

Still another feature of the invention is that at least a portion of the stripping means is located adjacent an outer edge portion of the pockets of the fly in the exit portion of the fly.

A further feature of the invention is that the device may have a moving conveyor belt onto which the signatures are delivered at a location adjacent the exit portion of the fly.

Another feature of the invention is that the stripping means may be driven by the conveyor belt.

Still another feature of the invention is that the fly is driven at a greater rotational speed than the speed of the conveyor belt and stripping means.

Yet another feature of the invention is that the stripping means is driven at approximately the speed of the conveyor belt.

A feature of the invention is that the stripping means comprises an endless stripper belt supported upon a plurality of rotatable pulleys.

Another feature of the invention is that at least a portion of the stripper belt is aligned with the pockets in the exit portion of the fly.

A further feature is that the stripping belt is driven around the fly.

Another feature of the invention is that the fly has an inner hub, and the stripping means has a rotatable pulley which is free wheeling on the hub.

Still another feature of the invention is that the stripper belt passes around the free wheeling pulley.

Further features will become more fully apparent in the following description of the embodiments of this invention and from the appended claims.

DESCRIPTION OF THE PREFERRED EMBODIMENTS

Figure 1:
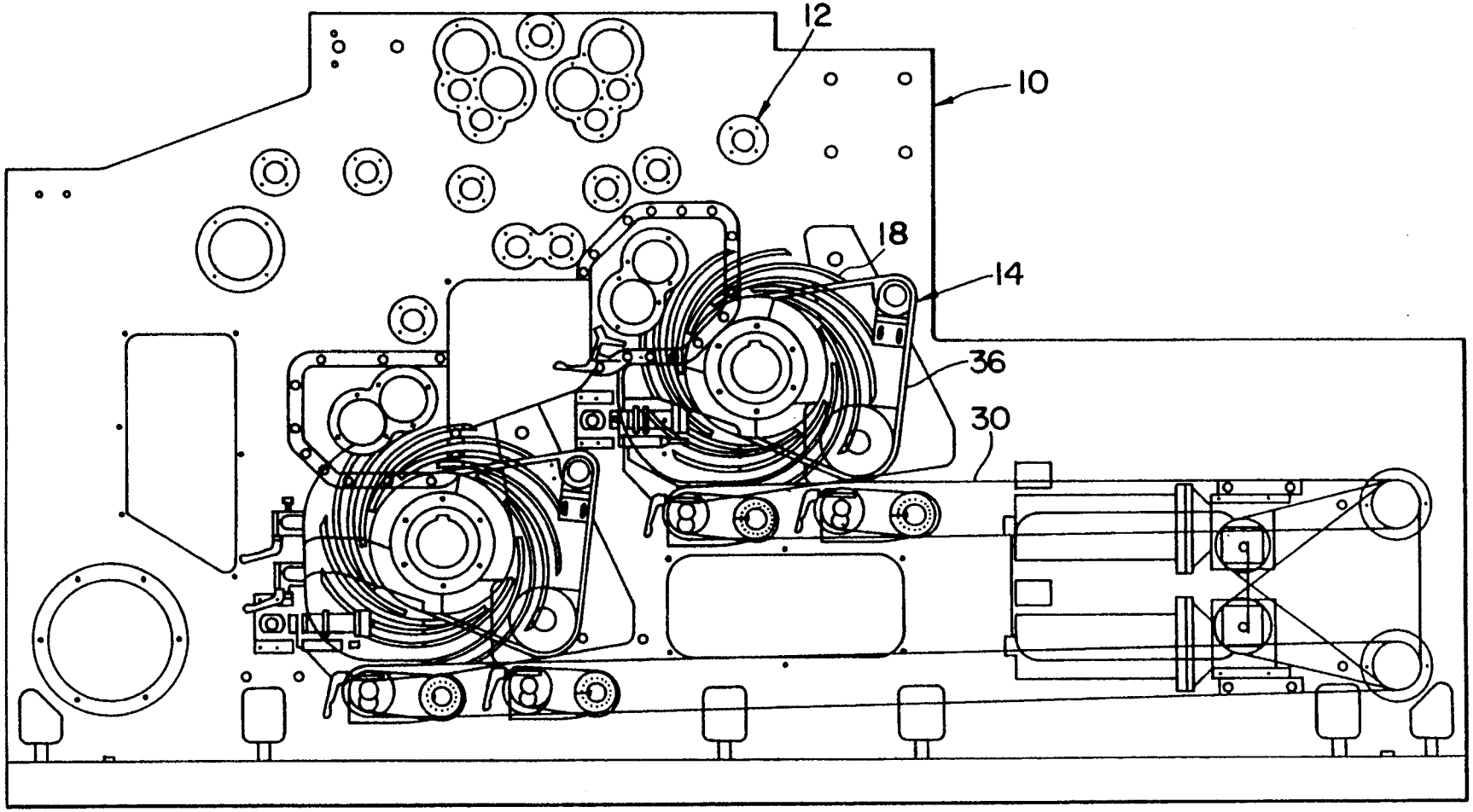
FIG. 1 is a side elevational view of a folder and a stripping device for a printing press of the present invention.
Figure 2:
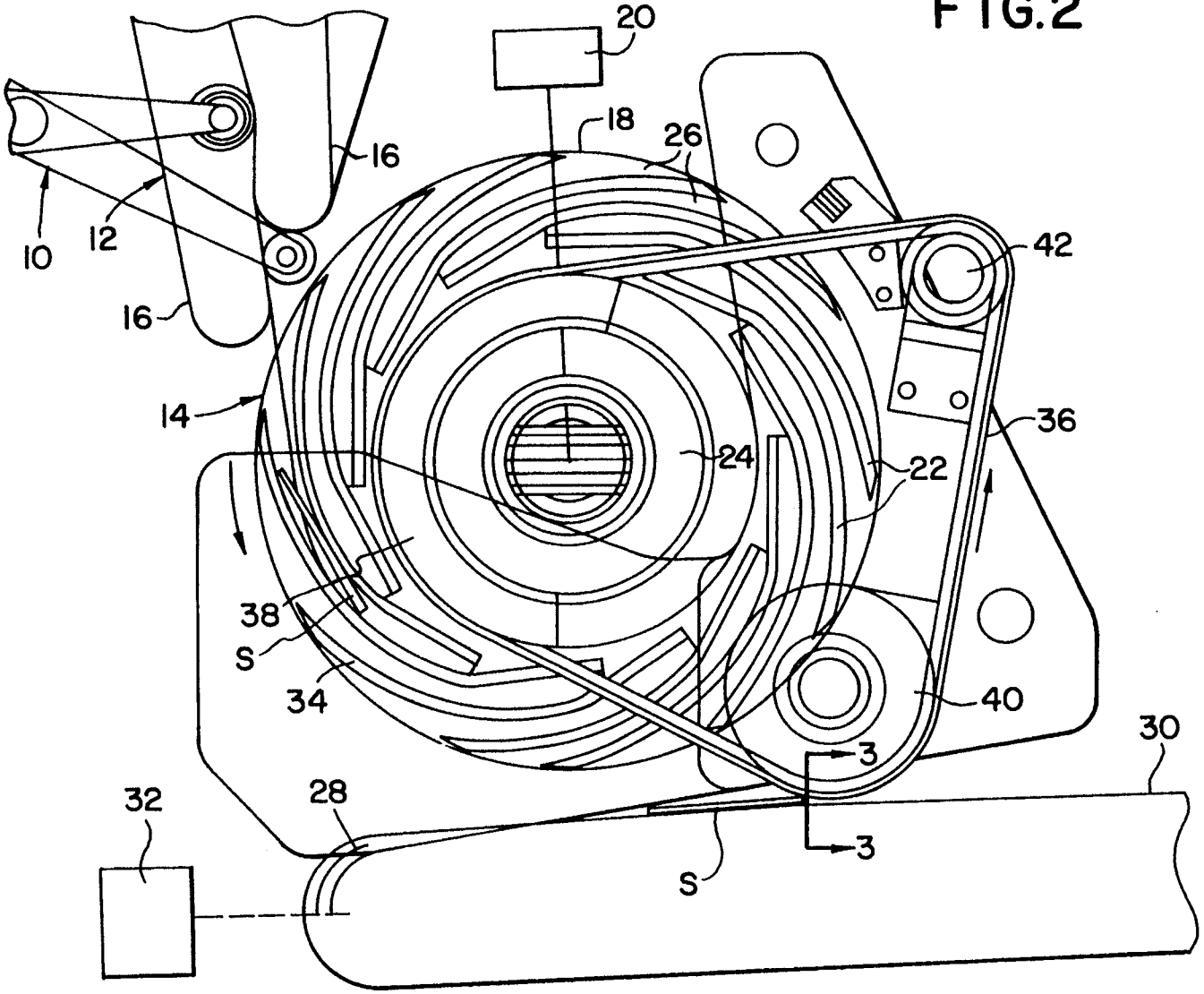
FIG. 2 is an enlarged side elevational view of the stripping device of FIG. 1.

Referring now to FIGS. 1 and 2, there is shown a printing press generally designated 10 having a folder generally designated 12 for folding signatures S, and which passes the signatures S to a stripping device generally designated 14 of the present invention. As shown, the folder 12 has one or more driven endless belts 16 for passing the folded signatures S to the stripping device 14.

As best shown in FIG. 2, the stripping device 14 has a rotatable fly 18 rotatably driven by a suitable motor 20. The fly 18 has a plurality of arcuate arms 22 disposed peripherally around a central hub 24, with the arms 22 being directed outwardly from the hub 24, and with the arms 22 defining a plurality of open pockets 26 disposed peripherally around the hub 24. The motor 20 drives the hub 24 in order to rotate the pockets 26 around the movable fly 18, with separate pockets 26 sequentially receiving separate folded signatures S from the belts 16 of the folder 12.

The device 14 has an endless conveyor belt 30 which is mounted on rotatable pulleys 28, with at least one of the pulleys 28 being driven by a suitable motor 32 in order to move the conveyor belt 30 relative to the fly 18. As shown, the conveyor belt 30 is located adjacent an exit portion 34 of the fly 18 in a position to receive the signatures S from the pockets 26 of the fly 18 for delivery of the signatures S in a stacked configuration onto the conveyor belt 30. During this time, the stripping device 14 removes the signatures S from the pockets 26 of the fly 18 onto the conveyor belt 30.

Figure 3:
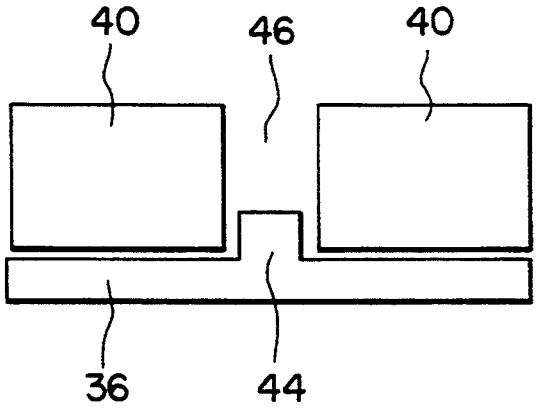
FIG. 3 is a sectional view taken substantially as indicated along the line 3—3 of FIG. 2.

The stripping device 14 has an endless stripping or stripper belt 36 passing around a plurality of rotatable pulleys 38, 40, and 42. The pulley 38 is free wheeling around the hub 24 of the fly 18, such the pulley 38 may freely rotate on the hub 24. As shown in FIG. 3, the stripping belt 36 has an inner central flange 44 which is received in a lateral central groove 46 in the pulleys 38, 40, and 42 in order to stabilize the stripper belt 36 on the pulleys.

With reference to FIG. 2, the stripper belt 36 passes around the pulley 40 at a location such that the stripper belt 36 engages the conveyor belt 30 in a configuration such that the conveyor belt 30 drives the stripper belt 36 at approximately the same speed as the conveyor belt 30, which speed is less than the rotational speed of the fly 18.

The stripper belt 36 passes around the hub 24 and pulley 38 in the pockets 26 of the fly 18. As shown, the stripper belt 36 is disposed at an acute angle in the pockets 26 of the fly 18 in the exit portion 34 of the fly 18, and at least a portion of the stripper belt 36 is located adjacent an outer end portion of the pockets 26 in the exit portion 34 of the fly 18. The moving stripper belt 36 thus engages against the inner edge of the signatures S in the pockets 26 in the exit portion 34 of the fly 18 in order to push the signatures S out of the pockets 26 in a shingled configuration onto the conveyor belt 30 for delivery of the signatures S to a delivery location adjacent the other end of the conveyor belt 30.

The conveyor belt 30 and striper belt 36 move at a speed which reduces the relative velocity between the rotating fly 18 and the stripper belt 36 with relationship to a stationary configuration of the stripper belt 36. Thus, the stripper belt 36 gently pushes the signatures from the pockets 26 progressively along the exit portion 34 of the fly 18, with the signatures S being delivered from the fly 18 onto the conveyor belt 30.

In this manner, the stripping device 14 releases the signatures S from the fly 18 without denting or marking the leading edge of the signatures which need not be a folded edge. In the past, stationary stripping devices could only be used on a folded edge of the signatures, and not the cut edge of the signatures, else the signatures would become marked by the stripping device 14 on the cut edge at relatively high speeds of the press, such as 2,000–3,000 ft./min.. In the event that the marking is large enough such that a portion of the mark remains after trimming the signatures, then the printed and folded signatures S are rendered worthless, and must be discarded, causing inconvenience and waste by the press. In accordance with the present invention, the stripping device 14 may be even used on the cut edge of the signatures S without marking, thus greatly improving the handling of the signatures, and eliminating significant inconvenience and waste during operation of the press 10.

The foregoing detailed description has been given for clearness of understanding only, and no unnecessary limitations should be understood therefrom, as modifications will be obvious to those skilled in the art.

What is claimed is:

1. A device for delivering signatures in a printing press, comprising:

a fly having a plurality of open pockets to receive signatures;

means for rotating said fly;

means for stripping the signatures from the fly in an exit portion of the fly; and means for driving the stripping means at a speed relative to the speed of the fly in a manner reducing their relative velocity less than the relative velocity between the fly and a stationary condition of the stripping means.

2. The device of claim 1 wherein the stripping means is disposed at an acute angle relative to the pockets of the fly.

3. The device of claim 1 including a conveyor belt onto which the signatures are delivered from the pockets of the fly in the exit portion of the fly, and means for moving the conveyor belt to receive the signatures from the fly.

4. The device of claim 3 wherein the driving means comprises the moving means of the conveyor belt, such that the stripping means is driven at substantially the same speed as the conveyor belt.

5. The device of claim 1 wherein the stripping means comprises an endless stripping belt passing around the fly, and in which the driving means moves the stripping belt around the fly in a plurality of pockets of the fly and adjacent the exit portion of the fly.

6. The device of claim 5 including a plurality of pulleys supporting the endless stripping belt.

7. The device of claim 5 wherein at least a portion of the stripping belt is located adjacent an outer end portion of the pockets adjacent the exit portion of the fly.

8. The device of claim 5 wherein the fly includes an inner hub located inwardly from the pockets of the fly, in which the stripping means includes a free wheeling stripper pulley supported on the hub, and in which the stripping belt passes around the stripping pulley.

9. The device of claim 8 including a conveyor belt adjacent the exit portion of the fly to receive the signatures from the pockets of the fly, including a plurality of pulleys supporting the stripping belt, and in which one of the pulleys is located adjacent the conveyor belt such that it is driven by the conveyor belt.

10. The device of claim 1 wherein the rotating means moves the fly at a greater angular speed than the speed of the stripper belt.

11. The device of claim 1 including a folder for the signatures, and in which the folder is located to place separate signatures in separate pockets of the fly during rotation of the fly.

12. The device of claim 1 wherein at least a portion of the stripping means is located adjacent an outer end portion of the pockets in the exit portion of the fly.

13. A device for delivering signatures in a printing press, comprising:

a fly having a plurality of pockets spaced around the fly to receive signatures;

means for rotatably driving the fly;

an endless conveyor belt positioned to receive signatures from the fly adjacent an exit portion of the fly;

an endless stripper belt passing around the fly in the pockets adjacent the exit portion of the fly;

a plurality of pulleys supporting the stripper belt; and means for moving the stripper belt around the fly to strip signatures from the pockets adjacent the exit portion of the fly, said moving means being driven by the conveyor belt at a speed less than the rotational speed of the fly.

* * * * *